United States Patent [19]

Gordon et al.

[11] Patent Number: 4,930,682

[45] Date of Patent: Jun. 5, 1990

[54] RECLOSEABLE LID CONSTRUCTION FOR A PAPERBOARD CONTAINER

[75] Inventors: Robert L. Gordon, Monroe; Robert E. Rehm, Chester; Robert Sosnowski, Monroe, all of N.Y.

[73] Assignee: International Paper Company, Purchase, N.Y.

[21] Appl. No.: 450,938

[22] Filed: Dec. 15, 1989

[51] Int. Cl.[5] ..... B65D 5/54

[52] U.S. Cl. ..... 229/123.3; 229/123.2; 229/125.08

[58] Field of Search ..... 229/123.2, 123.3, 125.08, 229/125.26; 220/269

[56] References Cited

U.S. PATENT DOCUMENTS

| | | | |
|---|---|---|---|
| 1,773,553 | 8/1930 | Taylor et al. | 229/123.3 |
| 2,719,663 | 10/1955 | Meyer-Jagenberg | 229/123.3 |
| 3,391,852 | 7/1968 | Waldrop | 229/125.08 |
| 4,433,808 | 2/1984 | Gordon et al. | 229/123.2 |
| 4,673,126 | 6/1987 | Hambleton | 229/123.3 |

*Primary Examiner*—Gary Elkins
*Attorney, Agent, or Firm*—Michael J. Doyle

[57] ABSTRACT

A recloseable lid construction for a paperboard container. The lid is a separate sheet and carries two radially spaced microcuts near its outer periphery. The radially outermost peripheral portion of the lid is bent upwardly and is sandwiched by an inwardly folded strip, the latter integral with the upper vertical side wall of the container. The inwardly folded strip carries a cutout which is aligned with an upwardly extending opening tab integral with the lid. Upon opening, the tab is pulled and separated from the radially outermost lid portion, and the two microcuts act to rip the paperboard and form a ledge around the dispensing opening. The lower portion of the inwardly folded strip is radially inwardly flared to define a snap reclosure. At least one of the microcuts in is filled and caulked with a barrier layer material, the barrier layer material also, preferably, covering the entire lid surface having the caulked microcut.

7 Claims, 2 Drawing Sheets

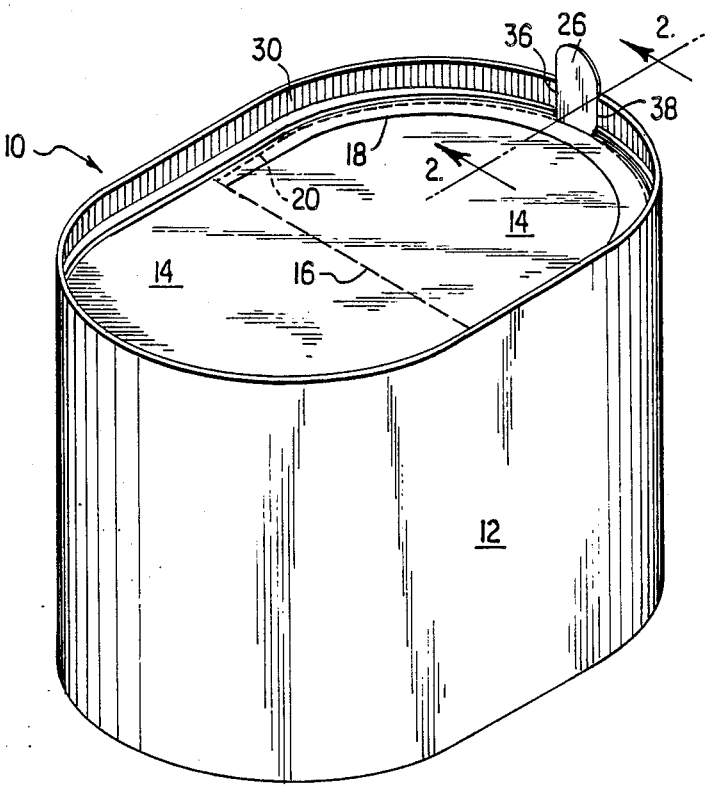
FIG. 1
FIG. 2
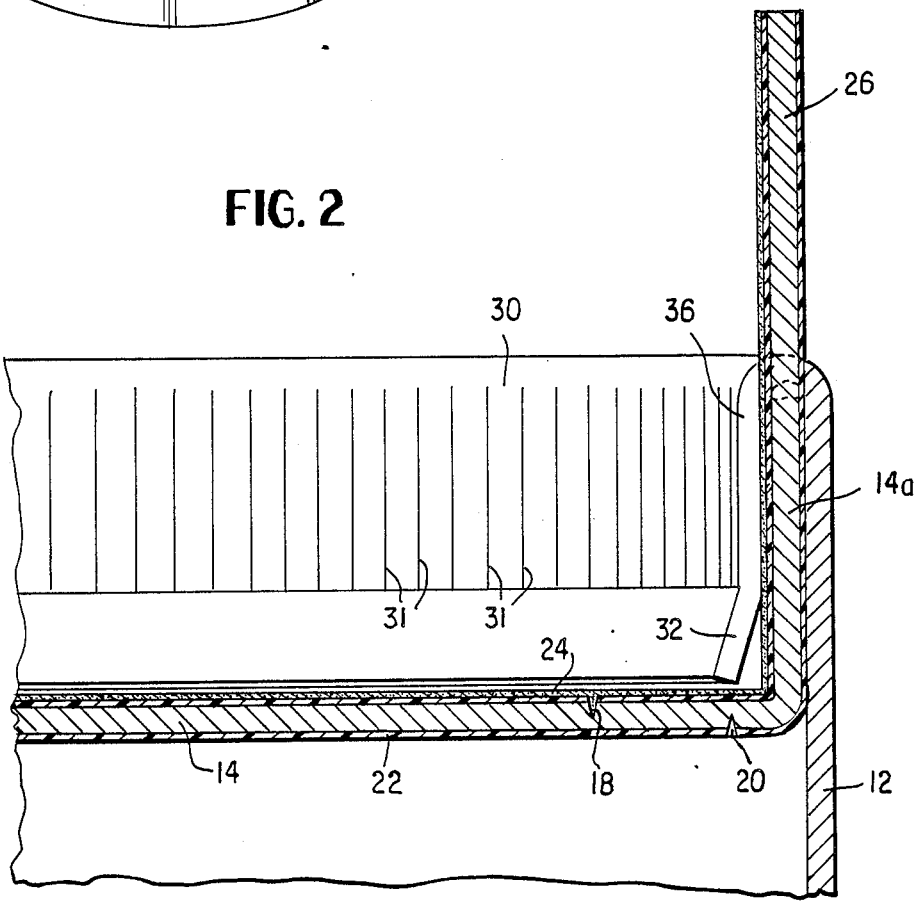

FIG. 3
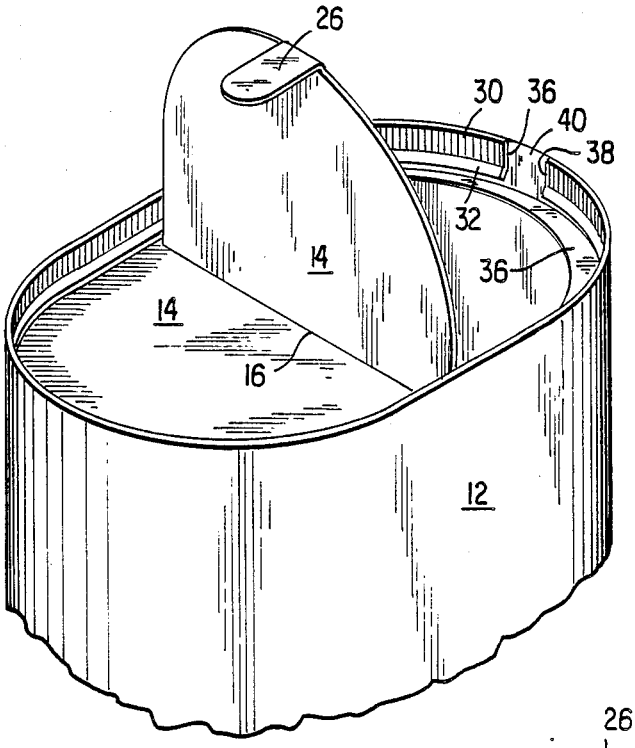
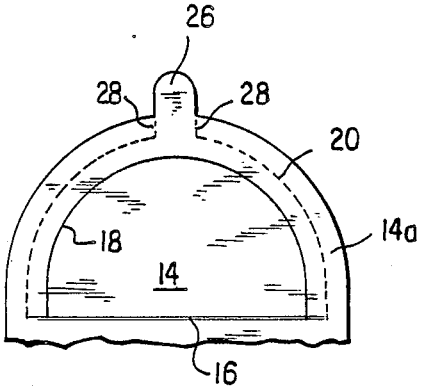
FIG. 5
FIG. 4
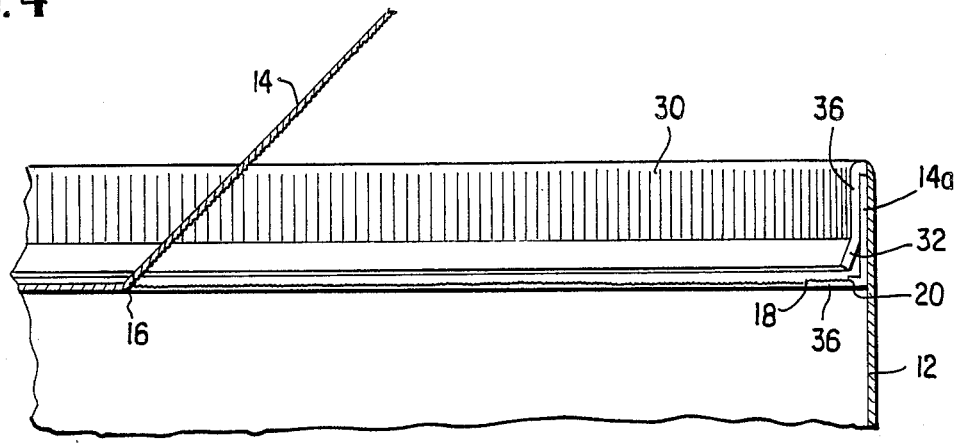

RECLOSEABLE LID CONSTRUCTION FOR A PAPERBOARD CONTAINER

BACKGROUND OF THE INVENTION

This invention relates to paperboard containers and more particularly to a paperboard container used for cereals, snacks, candy and the like. Such containers in many cases have inner bags, outer wraps or plastic reclosing lids, all of which are usually expensive and difficult to use.

The paperboard container art is aware of containers having recloseable lids. These containers may be square, rectangular, oval or round in shape. For example, U.S. Pat. No. 4,673,126 issued to Hambleton discloses a paperboard container having an openable and recloseable lid, the top or dispensing end of the container having a moisture barrier (barrier layer) in the form of a membrane. The arrangement is such that when the lid is pivoted upwardly to initially open the container for dispensing, a portion of the membrane liner adhering to the pivoted lid is ripped away from the remainder of the membrane.

While this arrangement permits a barrier layer seal with it consequent shelf life enhancing advantages for the packaged product, it is somewhat expensive to properly fabricate.

SUMMARY OF THE INVENTION

According to the practice of this invention, a paperboard container having the equivalent of a barrier layer is formed, but without the requirement of a separate barrier layer membrane which is ruptured upon initial opening of the container for dispensing. This is accomplished by providing one or both surfaces of an openable and recloseable lid with a coating of barrier layer material such as a wax or a polymer, and providing the lid with a pair of radially spaced microcuts extending from opposite lid surfaces. The coating is applied after die cutting to form the microcuts. The coating provides the equivalent of a moisture barrier layer, and is by this construction effectively integral with the lid so that a separate barrier layer sheet is not required. The coating fills and covers the microcut area and volume. Further, the arrangement of the reverse cuts in the lid is such that upon initial lid opening a shelf is formed extending substantially around the dispensing opening. This shelf forms an abutment to limit the extent of reclosure of the lid after initial partial dispensing of the container.

Further, according to the practice of this invention, the lid is provided with an integral pull tab, the pull tab lying in a void or cutout in a foldover flange or strip formed from the top portion of the container wall.

BRIEF DESCRIPTION OF THE DRAWINGS

FIG. 1 is a perspective view of a paperboard container provided with the recloseable lid construction of this invention.

FIG. 2 is a view taken along Section 2—2 of FIG. 1.

FIG. 3 is a view similar to FIG. 1, and illustrates the configuration of the: carton after the lid has been initially opened for dispensing.

FIG. 4 is a cross sectional view of the container showing the partially lifted lid.

FIG. 5 is a partial plan view of the lid forming blank prior to its assembly to the remainder of the container.

DETAILED DESCRIPTION OF THE INVENTION

Referring now to the drawings, numeral 10 denotes generally a paperboard container provided with the recloseable lid construction of this invention. The vertically extending sidewall of the container is denoted as 12. The lid for the container is denoted as 14, the lid provided with a scoreline 16 which forms a hinge which permits one portion of the lid to hinge or pivot relative to the other part. The lid is further provided with a first microcut denoted by the numeral 18, while the numeral 20 denotes a second lid microcut. As shown at FIG. 2, these radially spaced microcuts are reverse cut, with cut 18 extending from the top lid surface down and the other cut 20 from the bottom lid surface up. The numeral 22 denotes a (conventional) polymeric primary coating on the entire surfaces of both the upper and lower surfaces of paperboard lid 14. A secondary barrier layer coating 24 is applied to the upper coated lid surface after microcut 18 has been made in both the paperboard of the lid and the top polymeric coating 22. If secondary coating 24 was not applied, the lid would not function as a barrier layer, because the microcuts 18 and 20 pass approximately one-half through the thickness of the (porous) paperboard of lid 14. The coating 24 fills and caulks cut 18 to thereby define and maintain a barrier layer function. The upper surface only of lid 14 is coated by secondary barrier layer coating 24 in the embodiment illustrated. Were the lower lid surface also coated, as may be done, its barrier layer coating would have to be FDA approved for direct food contact if food were packaged. The entire surfaces of lid 14 may be coated by 24, or only the portions which contain the microcuts 18 and 20.

An integral pull tab 26 extends outwardly from the periphery of lid 14 and is normally positioned vertically upwardly prior to initial opening.

A foldover (inwardly foldable) strip or flange 30 includes folds or crimps 31, the flange or strip defined by folding over, at approximately 180 degrees, the upper edge of sidewall 12. Foldover strip 30 extends very nearly completely around the annular periphery of the upper edge of the container, except for cuts 36 and 38 which define a cutout 40 in downwardly extending flange 30. These cuts are best seen at. FIG. 3. From a consideration of FIGS. 2 and 4, it will be seen that the upwardly extending peripherial lid portion **14*a*, being the lid sidewall, is clamped or sandwiched by the upper portion of sidewall 12 and infold flange 30, except in the region of pull tab 26. Pull tab 26 is defined by parallel perforations 28, shown at FIG. 5, on lid sidewall 14*a* which commence at microcut 20 and which extend to the outer periphery of lid sidewall 14*a*. These perforations are aligned with cuts 36 and 38, the latter made before assembly by pre-cutting the blank which forms sidewall 12 and flange 30. FIG. 2 shows that the plane of pull tab 26 is parallel to the plane of infold 30**, at the angular position of the pull tab on the upper periphery of the container.

The lower third of infold flange 30 is tilted radially inwardly and is denoted as 32. At FIG. 2, it is seen that the lower end of 32 is approximately coincident with radially outermost microcut 20. This arrangement effects an automatic snap lock reclosure, such that in both opening and reclosure, a lower end of snap reclosure strip 32 must be displaced to permit passage of the semicircular periphery of the hingable part of lid 14.

FIG. 5 illustrates the hingable portion of the paperboard blank which forms the lid, prior to lid assembly to form the carton top. Tab 26 is seen as projecting outwardly from lid portion 14*a*. The base of the tab is defined by perforated cuts 28 which extend through lid portion 14*a*. After bending lid portion 14*a* so that it is sandwiched, as previously described, the tab separates along cuts 28 from portion 14*a*.

Upon initial opening, the tip of tab 26 is grasped and pulled upwardly. This causes a rupture of the parallel perforations 28 and frees the edges of the tab from skirt 14*a* of lid 14. The lid portion to the right of 16 commences to swing up about score line 16, with the action of microcuts 18 and 20 being such to define a radially inwardly extending shelf 36 around the dispensing opening which is formed upon tearing or ripping of the paperboard lid in the regions of the microcuts. The shelf is seen at FIGS. 3 and 4 and functions as an abutment or stop to limit downward motion of the right part of the lid upon reclosure. The formation of shelf 36, of a thickness of about one-half the thickness of the lid, depends upon the character of paperboard 14 during tearing of the fibers of the paperboard. The tearing commences at radially outermost cut 20 and terminates at innermost cut 18. The primary and secondary coatings 22 and 24 produce a relatively stiff construction for the shelf. Without additional coatings 22 and 24, it is probable that the paperboard fibers alone might not yield enough strength to define a fairly rigid shelf 36.

In practice, the snap reclosure, defined by inwardly flaring reclosure strip portion 32, is more or less automatically formed by clamping, during the assembly process, only the uppermost two-thirds of infold strip 30 during assembly of the container, with the lower one-third of this strip, being reclosure strip portion 32, being forced out at a slight angle by the pressure of clamping during assembly. The combination of microcut 20 and the relatively small tilt angle of strip portion 32 yields a positive top reclosure which snaps.

The bottom closure construction of the container is not illustrated, as it forms no part of the invention.

The terms horizontal, vertical, and other geometrical terms of orientation are employed to assist the reader in understanding of the invention and are not intended as terms of limitation.

We claim:

1. A recloseable lid construction for an annular paperboard container having a vertically extending side wall, a paperboard lid spanning and covering the upper, open end of the container, said lid having a radially outermost peripherial portion, said lid having a pair of radially spaced microcuts adjacent at least a portion of its periphery, said microcuts having a depth of about one half of the thickness of the lid, each microcut extending from a respective one of the two surfaces of said lid, the radially outermost microcut extending upwardly from the lid bottom surface, said lid having its peripheral edge bent upwardly, an integral lifting tab projecting outwardly from said peripheral edge, the upper portion of said side wall having an inward bend of about 180 degrees to form a fold over strip to sandwich the upwardly bent edge of the lid, a cut out segment on the fold over strip aligned with said lifting tab, the end of the tab projecting beyond the upper edge of the container, the uppermost portion of said fold over strip being substantially parallel to said side wall, the lower portion of said fold over strip being tilted radially inwardly to define a latching strip portion whose lower end extends radially inwardly of the radially outermost microcut, whereby opening of the container is effected upon pulling the lifting tab up, the tab separating from the lid radially outermost portion, the lid rips along the lid microcuts and is displaced upwardly to define a dispensing opening and to permit dispensing of any contents of the container, and whereby the lid is reclosed by pushing its displaced portion back to substantially its original horizontal position, whereby the tilted latching strip effects a snap reclosure for the lid, and whereby a radially inwardly extending shelf is formed by the spaced microcuts upon lid lifting, the shelf serving as an abutment to limit the extent of reclosure of the lid.

2. The lid construction of claim 1 wherein the lid is scored to produce a hinge line about which a part of the lid hinges upon opening of the container.

3. The lid construction of claim 2 wherein said microcuts each have two ends both of which terminate at said lid hinge line.

4. The lid construction of claim 1 wherein a barrier layer coating fills and caulks a microcut on at least one of the surfaces of the lid.

5. The lid construction of claim 1 wherein a polymeric, primary coating covers both the upper and lower lid surfaces and wherein the microcuts extend through the polymeric, primary coatings and wherein a secondary barrier layer coating fills and caulks at least one of the microcuts.

6. The lid construction of claim 4 wherein said caulked microcut extends from the upper lid surface.

7. The lid construction of claim 5 wherein said secondary barrier layer caulked microcut extends from the upper lid surface.

* * * * *